US005083099A

United States Patent [19]

Lagerlöf

[11] Patent Number: 5,083,099

[45] Date of Patent: Jan. 21, 1992

[54] FIELD-TWISTING WAVEGUIDE JUNCTION

[75] Inventor: Rolf O. E. Lagerlöf, Mölnlycke, Sweden

[73] Assignee: Telefonaktiebolaget L M Ericsson, Sweden

[21] Appl. No.: 503,752

[22] Filed: Apr. 3, 1990

[30] Foreign Application Priority Data

Apr. 12, 1989 [SE] Sweden ..... 8901324

[51] Int. Cl.[5] ..... H01P 1/16

[52] U.S. Cl. ..... 333/21 R; 333/34

[58] Field of Search ..... 333/21 A, 21 R, 34

[56] References Cited

U.S. PATENT DOCUMENTS

| | | | |
|---|---|---|---|
| 2,802,991 | 8/1957 | Coale | 333/21 R |
| 3,157,845 | 11/1964 | White | 333/21 R |
| 4,620,163 | 10/1986 | Young | 333/21 R |
| 4,673,946 | 6/1987 | Hoover | 343/776 |

FOREIGN PATENT DOCUMENTS

| | | | |
|---|---|---|---|
| 863061 | 3/1961 | United Kingdom | 333/21 R |
| 1299032 | 12/1972 | United Kingdom . | |

OTHER PUBLICATIONS

Mantysalo et al; "A Double Ridged Tapered Waveguide Transition for Liquid Helium Crystat"; *4th Int'l Cyrogenic Engineering Conf.;* Eindhoven, Netherlands; 24–26 May 1972; pp. 351–353.

*Primary Examiner*—Eugene R. Laroche
*Assistant Examiner*—Benny Lee
*Attorney, Agent, or Firm*—Burns, Doane, Swecker & Mathis

[57] ABSTRACT

A field-twisting waveguide junction (20) for electromagnetic microwaves (S1) has a rectangle-like cross-section at one end (21) thereof. This cross-section deviates from a true rectangular shape, by virtue of an inwardly projecting ridge (22). The other end (23) of the junction (20) has a rectangular cross-sectional shape, and the cross-section of a central section (F-F) of the junction has an L-shape. The junction (20) comprises sections, in the illustrated embodiment six sections, the cross-sectional shapes of which are changed step-wise between the sections. The width direction (B2) of the rectangular cross-section (23) has the same directional sense as the height direction (h1) of the inwardly projecting ridge (22). The junction (20) is intended for connecting a rectangular waveguide to a ridge waveguide and transfer the microwaves (S1). The microwave has an electrical field vector (E) whose direction is rotated through one-quarter of a revolution during transfer of the microwave.

12 Claims, 6 Drawing Sheets

Fig. 4a
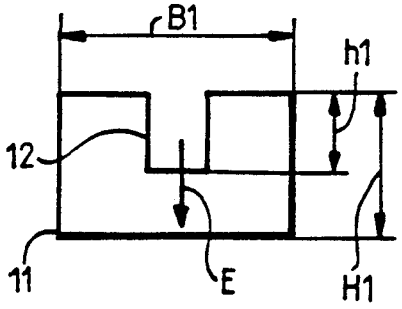
Fig. 4b
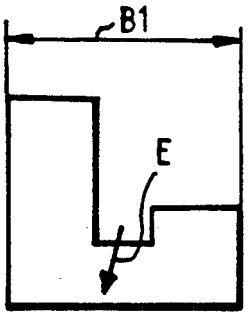
A-.A
Fig. 4c
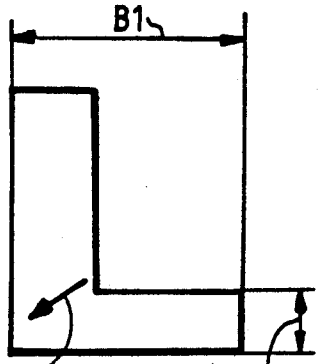
B-B
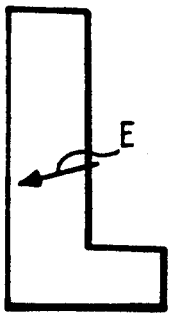
C-C
Fig. 4d
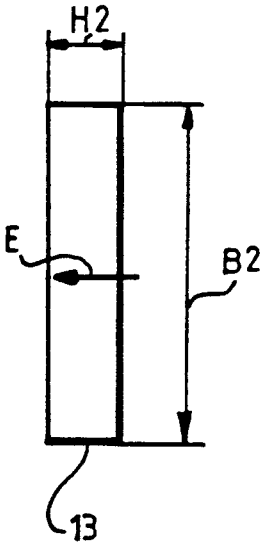
Fig. 4e Fig. 6a
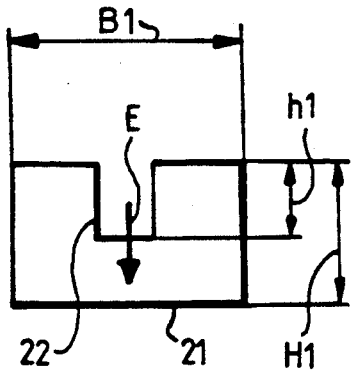
Fig. 6b
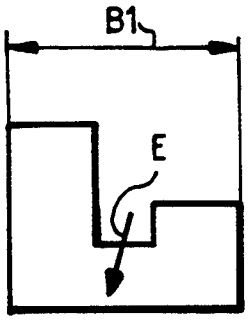
D-D
Fig. 6c
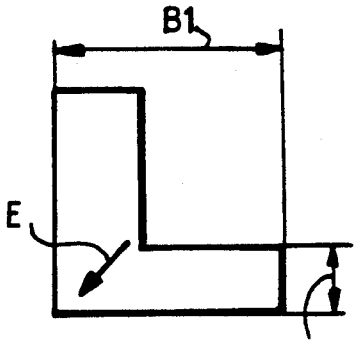
F-F
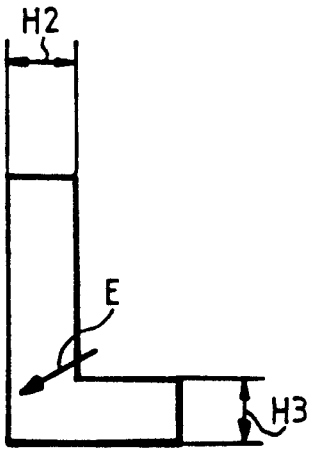
G-G
Fig. 6d
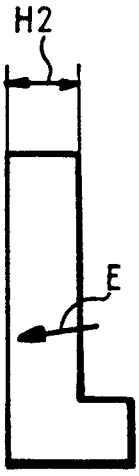
K-K
Fig.6e
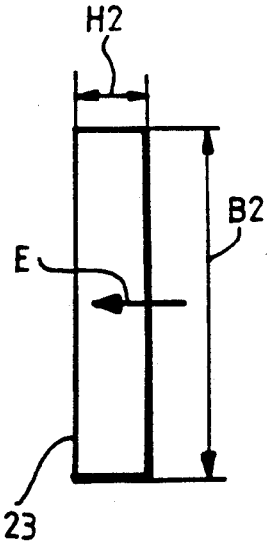
Fig. 6f

FIELD-TWISTING WAVEGUIDE JUNCTION

TECHNICAL FIELD

The present invention relates to a field-twisting waveguide junction in hollow waveguides intended for electromagnetic microwaves. The waveguide junction has at one end a rectanglelike cross-sectional configuration of desired height and width, said cross-sectional configuration deviating from a true rectangular shape by virtue of a ridge which, in the vertical extension of said cross-section, projects into the waveguide junction from one side of said cross-section, its ridge side, and the other end of which junction has a rectangular cross-sectional configuration, with one long side and one short side.

BACKGROUND ART

When transmitting electromagnetic microwaves through hollow waveguides, it is often desirable to be able to twist the direction of the electrical field vector. One arrangement for effecting such rotation is known, for instance, from UK Patent Specification No. 1 299 032. The arrangement includes a number of segments each having a length of one-quarter of a wave length and the segments being displaced angularly in relation to one another. The segments all have substantially the same cross-sectional shape and the device is intended to be connected at both ends thereof to hollow waveguides of rectangular cross-section. The U.S. Pat. No. 4,620,163 teaches devices for rotating the electrical field vector of a microwave. The devices are rectangular in shape at both ends thereof and merge continuously between the crosssections of said ends. It is known to use so-called ridge waveguides in many applications of hollow waveguides, for instance for radar antennas. Ridge waveguides are substantially rectangular in cross-section, but deviate from a true rectangular shape by virtue of a ridge which projects into the waveguide from one side thereof. Ridge waveguides are found described, for instance, in the second edition of "Introduction to Microwaves" by Fred E. Gardiol, Artech House, 1984. When using ridge waveguides for the aforesaid purposes, it is often desirable to be able to supply power to said waveguides via rectangular, hollow waveguides and to twist the electrical field vector as power is being supplied. Devices for effecting such power supply are known in which the field vector in the rectangular waveguide is first twisted through one-quarter of a revolution, whereafter the rectangular waveguide changes to a ridge waveguide. These devices are complicated and relatively bulky and are less suitable for use, e.g. in mobile radar antennas.

DISCLOSURE OF THE INVENTION

The aforesaid disadvantages are avoided in accordance with the invention by means of a waveguide junction which is intended to be connected at one end thereof to a ridge waveguide and at the other end thereof to a rectangular, hollow waveguide. The waveguide junction occupies only a small space, has low reflection losses and is operative to twist the electrical field vector through one-quarter of a revolution.

The waveguide junction has the characterising features set forth in the accompanying claims.

BRIEF DESCRIPTION OF THE DRAWINGS

The invention will now be described in more detail with reference to drawings, in which

FIGS. 4*a* thru 4*e* are views from above illustrating the cross-sectional shapes of the junction illustrated in FIG. 3;

FIGS. 6*a* thru 6*f* are views from above illustrating the cross-sectional shapes of the junction illustrated in FIG. 5.

BEST MODE FOR CARRYING OUT THE INVENTION

Figure 1:
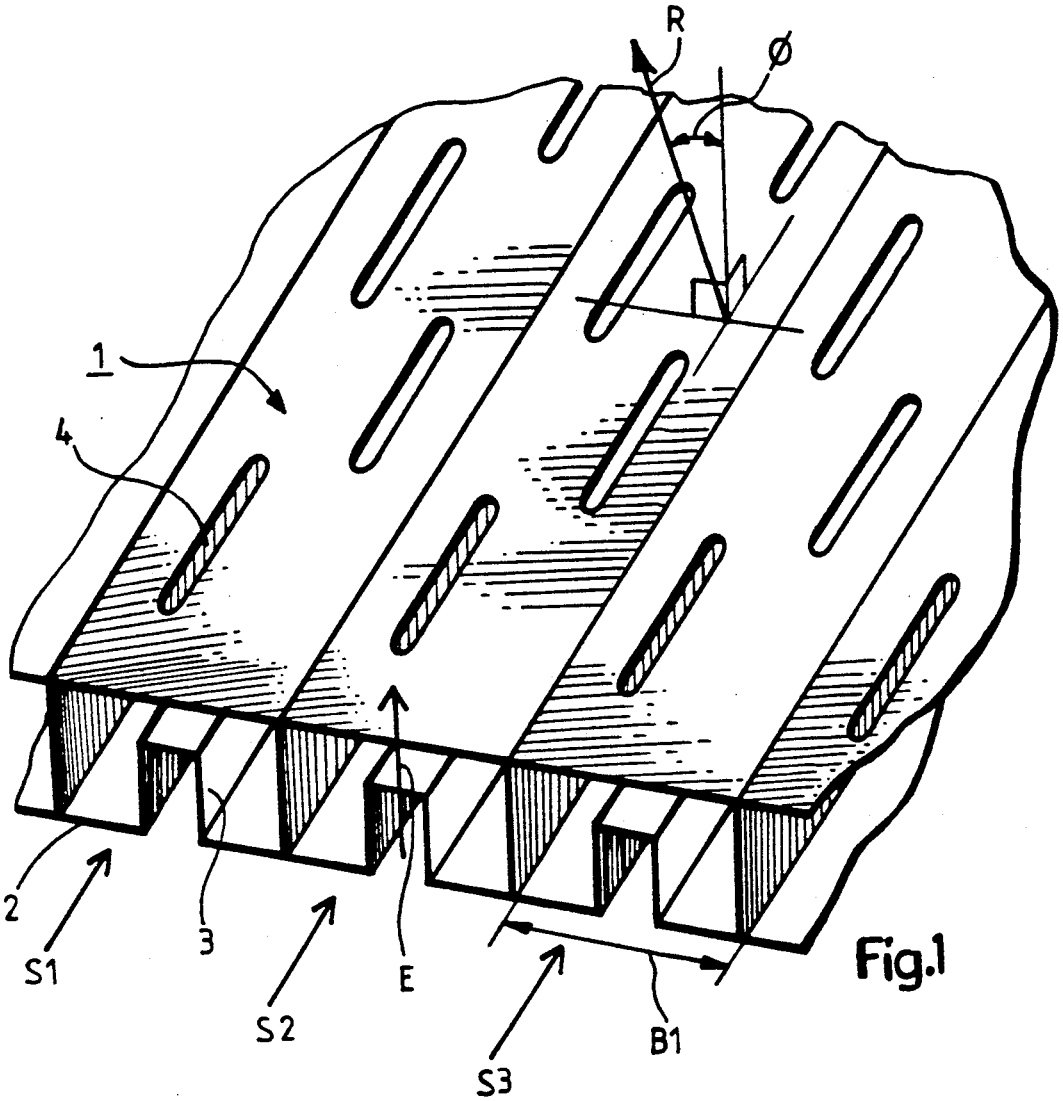
FIG. 1 is a perspective view of a part of a radar antenna.

A radar antenna may be composed of ridge waveguides, as mentioned in the introduction. FIG. 1 illustrates a part 1 of such a radar antenna, the ridge waveguides 2 of which have a width B1 and are placed in side-by-side relationship. The illustrated antenna has only three ridge waveguides 2, although it will be understood that the complete antenna will comprise a relatively large number of waveguides. Each of the ridge waveguides 2 has a longitudinally extending ridge 3 which extends into the waveguide from one side thereof, the ridge side, and slots 4 are provided on the opposite side of respective ridge waveguides 2. Power is supplied to the antenna by microwaves S1, S2, S3 of desired wavelength and microwave energy is emitted to the surroundings, through the slots 4.

Figure 2:
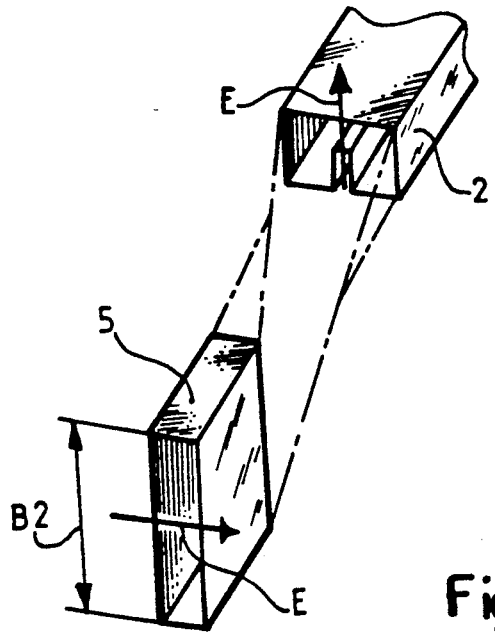
FIG. 2 is a schematic, perspective view of a waveguide junction.

The ridge waveguides 2 have the advantage that the width B1 of respective waveguide is relatively small in relation to the excitation wave length $\lambda$, e.g. $B1=0.4\lambda$. This enables the antenna 1 to be phase-controlled, i.e. an emitted radar wave R can be directed laterally through an angle $\phi$, by displacing the phase of the microwaves S1, S2 and S3 in relation to one another. In order to enable this to be achieved with solely one radiation lobe, it is necessary that $B1<\frac{1}{2}\lambda$. This condition can be fulfilled for the ridge waveguide 2, whereas in the case of a truly rectangular waveguide having a width B2 along one long side thereof, B2 will always be greater than $\frac{1}{2}\lambda$ (See FIG. 2). It is desirable in many applications to be able to supply power to the ridge waveguides 2 via their respective rectangular waveguides 5. This requires the provision of a waveguide junction between the rectangular waveguide 5 and the ridge waveguide 2, as indicated in broken lines in FIG. 2. It should be carefully noted that the waveguide junction in FIG. 2 is illustrated solely to show the mutual connection of the waveguides 2 and 5 and does not depict a true waveguide junction. The waveguide junction is required to rotate or twist the direction of the electrical field-vector E of the microwaves S1, S2, S3, so that the width-direction of the rectangular waveguides 5 of greater width will extend transversely to the width direction of the ridge waveguides. This will enable the rectangular waveguides 5 to be positioned on edge and in side-by-side relationship at the ends of the ridge waveguides 2 of the radar antenna 1.

Figure 3:
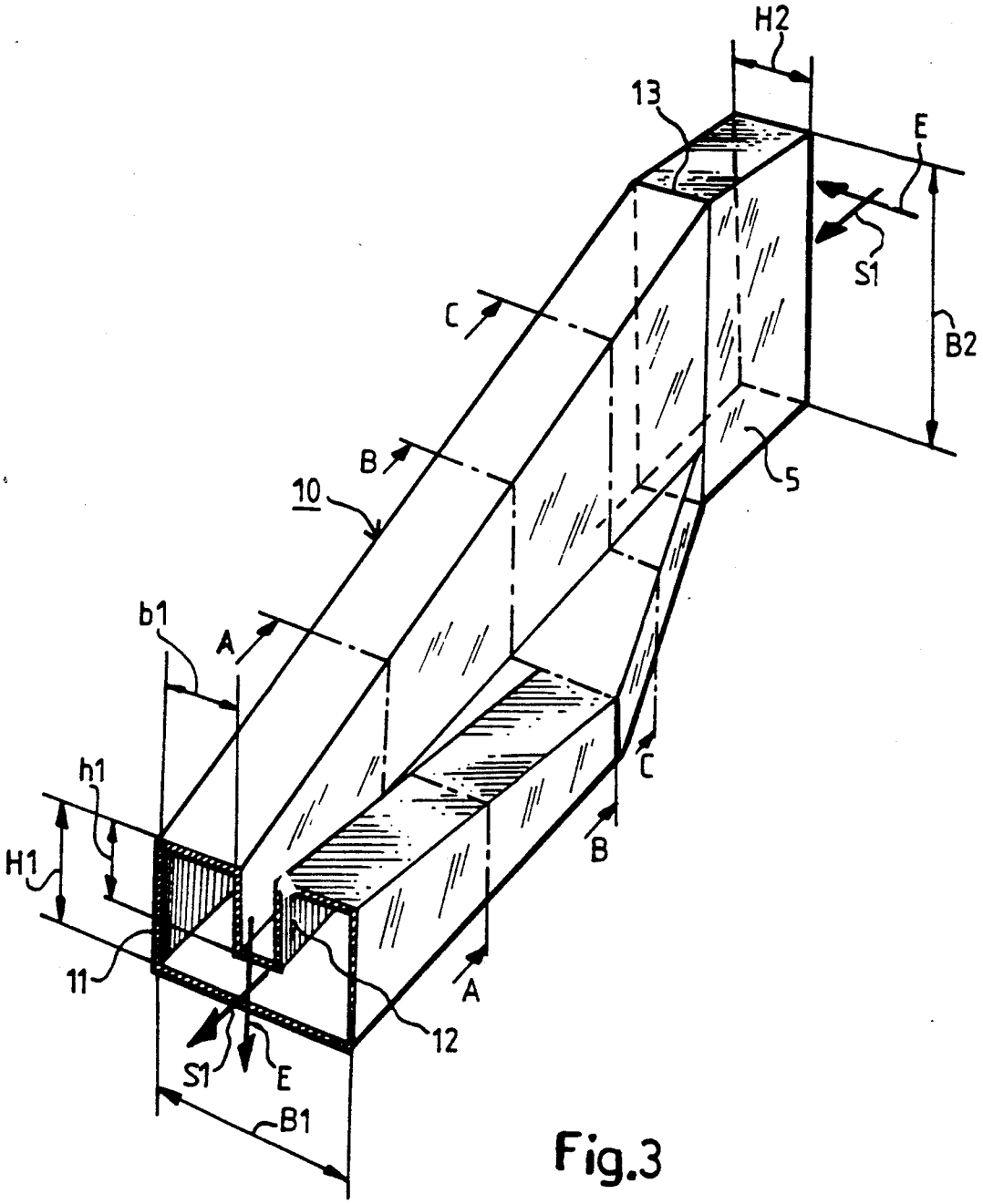
FIG. 3 is a perspective view of an inventive waveguide junction.

An inventive field-twisting waveguide junction 10 is illustrated in FIG. 3. One end 11 of the waveguide junction has a rectanglelike cross-sectional shape having the width B1 and a height H1. The cross-sectional deviates from a true rectangular shape by virtue of a ridge 12 which has a height h1 and projects into the waveguide from its ridge side. The cross-sectional shape of the waveguide junction at said end 11 corresponds to the cross-sectional shape of the ridge waveguide 2, and the waveguide junction 10 is intended to be connected to said ridge waveguide at said end 11. The other end 13 of the junction 10 has a true rectangular cross-sectional shape, having the width B2 and a height H2, wherein B2>B1. The cross-sectional shape at said end 13 corresponds to the cross-sectional shape of the rectangular waveguide 5, and the junction 10 is intended to be connected to said waveguide at said end 13. The width direction B2 of the waveguide cross-section at said end 13 extends in the height direction h1 of the ridge 12. The waveguide junction 10 is open at both ends 11 and 13 thereof, whereas the remainder of said junction is closed to the surroundings.

FIG. 4 is a view showing the cross-sectional shapes of the junction 10 at said ends 11 and 13, and also shows three intermediate cross-sections in drawing-sections A—A, B—B and C—C. FIG. 3 illustrates where these sections are taken. The waveguide junction 10 has a first part presenting the width B1, which extends from the end 11 to the centre cross-section B—B. The height of the junction 10 decreases on one side of the ridge 12 and on the other side of said ridge 12 its height increases to a corresponding extent along the first part of the waveguide junction 10. The centre cross-section B—B is L-shaped and on one side of the ridge 12 has a height H3, wherein H1−h1=H3. The waveguide junction 10 has a second part which extends from the centre L-shaped cross-section B—B to the other end 13 of the junction 10. An extension line in the direction of the ridge 12 can be conceivably drawn along this second part of the waveguide junction. The extension of the junction 10 decreases on one side of this extension line, in the transverse direction of the vertical extension or height h1 of the ridge 12. The extension of the junction increases in the height direction of the ridge on the other side of the extension line of the ridge 12. The defining surfaces of the junction 10 slope continuously between the illustrated sections and the configuration of the junction is changed in a wedge-like fashion along the direction of its longitudinal axis The height H2 is smaller than a width b1 of those parts of the rectangular-like cross-section 11 located on both sides of the ridge 12.

The microwave used to feed power to the radar antenna 1, for instance the microwave S1, enters through the rectangular waveguide 5 connected to the waveguide junction 10 in accordance with FIG. 3. The microwave S1 has a relative large wavelength and the microwave S1 is the fundamental mode of the electromagnetic waves in the waveguide junction 10. As illustrated in FIG. 4, the microwave S1 has an electrical field vector E whose direction is well defined. This direction is arrowed in the various cross-sections shown in FIG. 4. At the rectangular end 13 of the junction 10, the field vector A is directed transversely to the height direction of the ridge. During transportation of the microwave S1 through the junction 10, the field vector E is rotated continuously in an anti-clockwise direction and at the rectangular-like end 11 of the junction 10, the field vector E is substantially parallel with the height direction h1 of the ridge 12.

Figure 5:
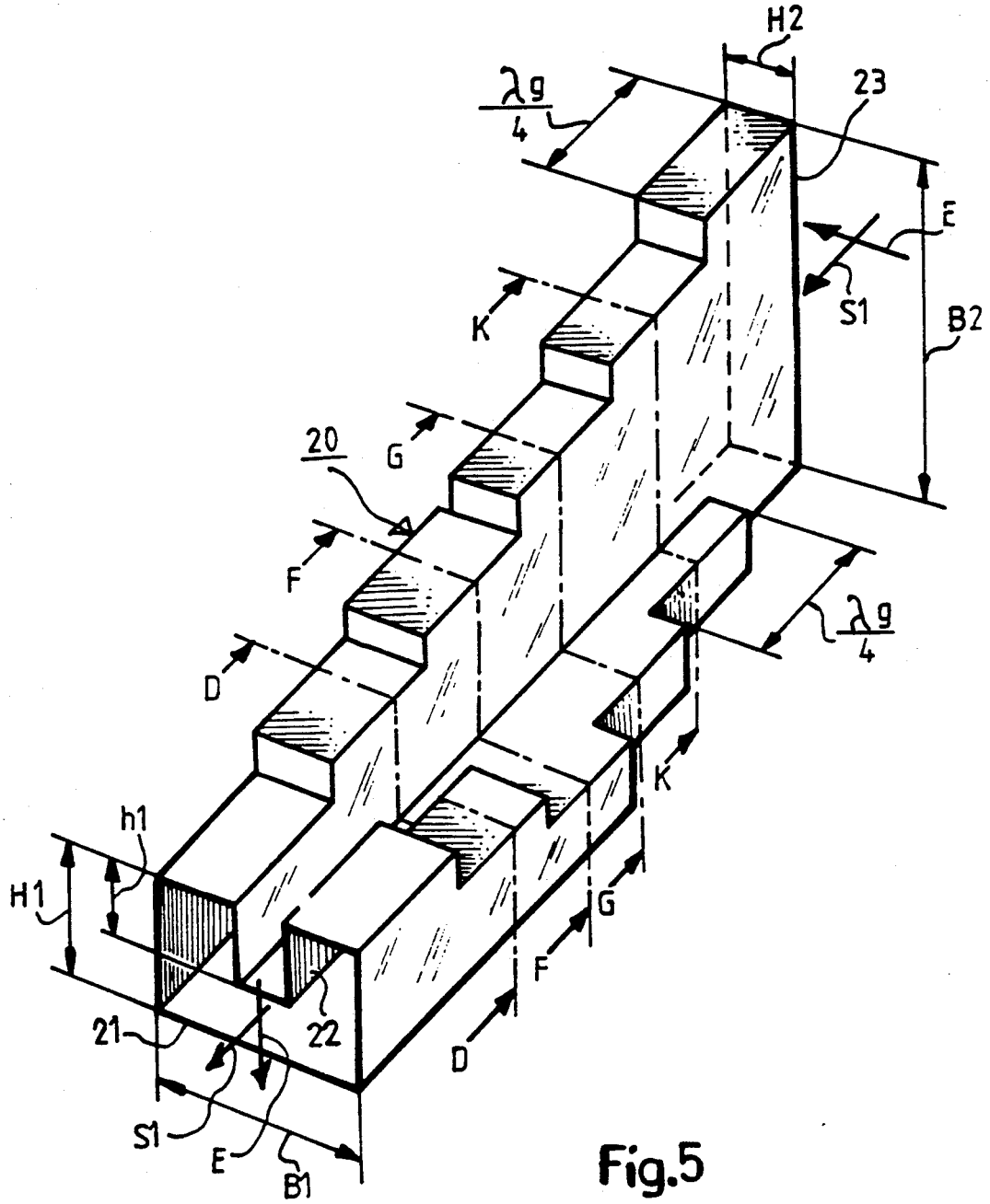
FIG. 5 is a perspective view of an alternative inventive waveguide junction.

An alternative, inventive waveguide junction 20 is illustrated in FIG. 5. The junction 20 has a rectanglelike cross-section at one end 21 thereof, with an inwardly projecting ridge 22. The cross-section 21 has the height H1 and the width B1 and the ridge 22 has the height h1. The other end 23 of the junction 20 has a rectangular cross-sectional shape, having the width B2 and the height H2. The extension of the junction 20 changes stepwise in the direction of the longitudinal axis thereof in sections, which are six in number. Each section has a length of $\lambda g/4$, where $\lambda g$ is the wave length of the microwave S1 in the junction 20. The width direction B2 of the junction cross-section at said end 23 extends in the height direction h1 of the ridge 22. The junction 20 is open at both ends 21 and 23 thereof so that said junction can be connected to the waveguides 2 and 5 respectively. The remainder of the junction is closed to the surroundings.

FIG. 6 illustrates the cross-sectional shapes of the aforesaid six sections at both ends 21 and 23 of the junction 20 and also at the intermediate sections D—D, F—F, G—G and K—K. The junction 20 has a first part having the width B1 extending from the end 21 to the end of the center section, the L-shaped cross-section of which is illustrated by the section F—F. The cross-sectional shape of the intermediate section is illustrated by the section drawing D—D. On one side of the ridge 22, this cross-section has a smaller extension in the height direction of the ridge 22 than the height H1, and on the other side of the ridge 22, the vertical extension is greater to a corresponding degree. In the drawing-section F—F, the L-shaped centre section has the height H3 on one side of the ridge 22, wherein H1−h1=H3, as mentioned above. The junction 20 has a second part which extends from the L-shaped centre section to the end 23. The cross-sectional shapes of the two intermediate sections are illustrated by the section-drawings G—G and K—K. On one side of an extension line of the ridge 22, to the right in FIG. 6, the extension of the junction 20 decreases in the cross-direction of the vertical extension h1 of the ridge along the longitudinal axis of the junction 20. The extension of the junction 20 increases to a corresponding degree in the vertical extension of the ridge 22 on the other side of said extension line.

The direction of the electric field-vector E of the microwave S1 is arrowed in the drawing-sections shown in FIG. 6, in a corresponding manner to that illustrated in FIG. 4.

The cross-sectional shapes of the two ends 21 and 23 of the junction 20 are the same as the cross-sectional shapes of the two hollow waveguides 2 and 5 respectively, to which the waveguide junction 20 is intended to be connected. These two end-sections may comprise respectively the actual waveguides 2 and 5 themselves. It should be observed, however, that the electromagnetic field will also undergo changes in these two end-sections. A small twist in the electrical field vector E is an example of such changes. When considered solely as a mechanical device, the waveguide junction need not include these two end-sections. When considered from a waveguide aspect, the waveguide junction 20 must be said to include the end-sections at said ends 21 and 23, even though these end-sections are parts of the connected waveguides 2 and 5 when viewed purely mechanically. The influence exerted by the junction 20 on the electromagnetic field in the hollow waveguides connected thereto extends into the waveguides through a distance of the order of λg/4, calculated from the first stepwise change of the cross-section. The influence exerted on the electromagnetic field is negligible further into the waveguides 2 and 5 respectively, i.e. externally of respective ends 21 and 23 of the junction 20.

All of the separate sections of the waveguide junction 20 have a length λg/4. As a result, the electromagnetic wave S1 is only reflected, to a small extent, in the junction 20. The sections may also be given other lengths conducive to counteract reflections, for instance the lengths λg/8 or λg/16.

Figure 7:
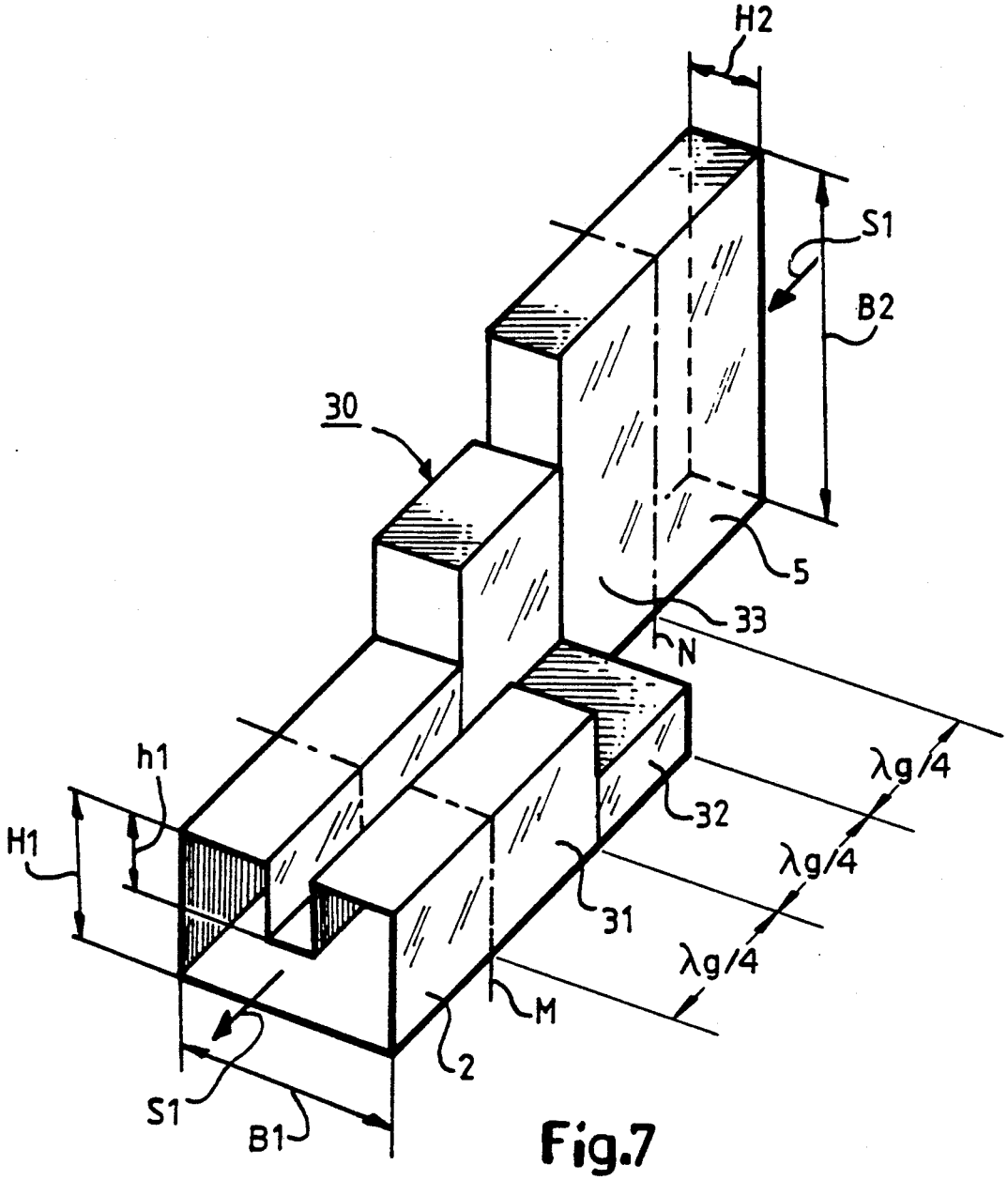
FIG. 7 is a perspective view of a further alternative waveguide junction according to the invention.

A further alternative, inventive waveguide junction 30 is illustrated in FIG. 7. The junction 30 has three sections 31, 32 and 33, between which the extension of the junction is changed in a step-like fashion. The centre section 32 has an L-shaped cross-section. The section 31 has, at one end of the junction, the same cross-sectional shape as the ridge waveguide 2, to which the junction 30 is intended to be connected. At the other end of the waveguide junction, the section 33 has the same cross-sectional shape as the rectangular waveguide 5. Each of the sections 31, 32 and 33 has a length λg/4, as described with reference to FIG. 5. The end-sections 31 and 33 may comprise parts of respective waveguides 2 and 5, these parts having been indicated in FIG. 7 with broken lines M and N respectively. In this case, seen from a purely mechanical aspect, the junction 30 comprises solely the centre section 32. Seen from the aspect of a waveguide for the electromagnetic wave S1, the junction 30, however, comprises all three of said sections 31, 32 and 33, with the explanation given with reference to FIGS. 5 and 6. The embodiment illustrated in FIG. 7 has the disadvantage that a relatively large part of the electromagnetic energy in the wave S1 is reflected, although it has the advantage of being very simple.

The aforedescribed inventive waveguide junction is able to transfer electromagnetic waves in both directions between a ridge waveguide and a rectangular waveguide. The waveguide junction has several advantages, inter alia, that the junction is of simple design and requires only little space, and has low reflection losses.

I claim:

1. A field-twisting waveguide junction for joining a rectangular hollow waveguide of re 'angular cross-section and a ridge hollow waveguide of rectangular block-U-shaped cross-section, an inside portion of said U forming as part of said ridged hollow waveguide a ridge extending in a first direction, a long side of said rectangular hollow waveguide being aligned substantially in said first direction, said field twisting waveguide junction comprising:

a first portion of varying cross-section having at one end thereof a cross-section substantially identical to that of said ridged hollow waveguide and having at another end thereof a substantially L-shaped cross-section enclosing a hollow cavity; and a second portion of varying cross-section contiguous with said first portion and having at one end thereof a cross-section substantially identical to that of said rectangular hollow waveguide and having at another end thereof said substantially L-shaped cross-section enclosing a hollowing cavity.

2. The field-twisting waveguide junction of claim 1 wherein said ridge extends in said first direction a first distance, and said substantially L-shaped cross-section differs from the cross-section of said ridged hollow waveguide by extending farther on one side of said ridge in a second direction opposite said first direction by an amount less than or equal to said first distance and extending less on an opposite side of said ridge in said second direction by a substantially equal amount.

3. The field-twisting waveguide junction of claim 2, wherein said varying cross-sections are varied continuously.

4. The field-twisting waveguide of claim 3 wherein intermediate said substantially L-shaped cross-section and said cross-section substantially identical to that of said rectangular hollow waveguide, said second portion has an extent in one dimension including said first and second directions greater than said substantially L-shaped cross-section but less than said rectangular hollow waveguide, and has an extent in said another dimension less than said substantially L-shaped cross-section but greater than said rectangular hollow waveguide.

5. The field-twisting waveguide junction of claim 4, wherein said varying cross-sections are varied in step intervals.

6. The field-twisting waveguide junction of claim 5 wherein said intervals are each one-quarter wavelength long.

7. The field-twisting waveguide junction of claim 4, wherein said varying cross-sections are varied continuously.

8. The field-twisting waveguide junction of claim 2, wherein said varying cross-sections are varied in step intervals.

9. The field-twisting waveguide junction of claim 8 wherein said intervals are each one-quarter wavelength long.

10. The field-twisting waveguide junction of claim 9 wherein said first portion and said ridged hollow waveguide are of substantially the same extend in another dimension perpendicular to said first and second directions.

11. The field-twisting waveguide junction of claim 8 wherein an intermediate cross-section of said first portion differs from said substantially L-shaped cross-section in that said amount is less than said first distance.

12. The field-twisting waveguide junction of claim 2 wherein said amount is equal to said first distance.

* * * * *